US011617424B2

(12) United States Patent
Detry

(10) Patent No.: US 11,617,424 B2
(45) Date of Patent: Apr. 4, 2023

(54) SECURE SLIDER FOR A ZIP FASTENER

(71) Applicant: DELSEY, Paris (FR)

(72) Inventor: Laurence Detry, Tremblay-en-France (FR)

(73) Assignee: DELSEY, Paris (FR)

( * ) Notice: Subject to any disclaimer, the term of this patent is extended or adjusted under 35 U.S.C. 154(b) by 509 days.

(21) Appl. No.: 16/632,199

(22) PCT Filed: Jul. 25, 2017

(86) PCT No.: PCT/EP2017/068816
§ 371 (c)(1),
(2) Date: Jan. 17, 2020

(87) PCT Pub. No.: WO2019/020174
PCT Pub. Date: Jan. 31, 2019

(65) Prior Publication Data

US 2020/0229551 A1 Jul. 23, 2020

(51) Int. Cl.

| | |
|---|---|
| ***A44B 19/30*** | (2006.01) |
| ***A45C 13/10*** | (2006.01) |
| *A44B 19/26* | (2006.01) |

(52) U.S. Cl.
CPC ..... *A44B 19/301* (2013.01); *A45C 13/103* (2013.01); *A44B 19/262* (2013.01)

(58) Field of Classification Search
CPC .... A44B 19/301; A44B 19/262; A45C 13/103
See application file for complete search history.

(56) References Cited

U.S. PATENT DOCUMENTS

| | | | | |
|---|---|---|---|---|
| 5,557,954 | A * | 9/1996 | Ling | E05B 37/12 70/68 |
| 8,499,422 | B2 * | 8/2013 | Jacobsen | A44B 19/34 24/384 |
| 8,650,724 | B2 * | 2/2014 | King | A45C 13/103 4/386 |
| 8,793,847 | B2 * | 8/2014 | Chung | A44B 19/382 24/415 |

(Continued)

FOREIGN PATENT DOCUMENTS

| | | |
|---|---|---|
| CA | 2 850 675 | 10/2015 |
| FR | 3 008 285 | 1/2015 |
| WO | 2017/174813 | 10/2017 |

OTHER PUBLICATIONS

International Search Report dated Mar. 20, 2018.

*Primary Examiner* — Robert Sandy
*Assistant Examiner* — Rowland Do
(74) *Attorney, Agent, or Firm* — IPSilon USA, LLP

(57) ABSTRACT

"A slide (100) for a zip fastener has a hasp (115) and a pull tab (120). This assembly is being moulded into a single block. The pull tab (120) has an eyelet (121) for connecting to the hasp of the slider. The pull tab (120) has a locking eyelet (122) the opening plane of which is parallel to the opening plane of the connection eyelet (121). The pull tab (120) has a portion (125) for connection between the two eyelets (121, 122), called the pull tab body, the width of the cross-section of the pull tab body in a direction perpendicular to the opening planes of the eyelets is greater than or equal to the height of the cross-section in the plane parallel to the opening planes of said eyelets."

7 Claims, 3 Drawing Sheets

(56) References Cited

U.S. PATENT DOCUMENTS

| | | | | |
|---|---|---|---|---|
| 9,220,323 | B2 * | 12/2015 | Hamada | F16B 45/04 |
| 2003/0066170 | A1 * | 4/2003 | Huang | A44B 19/301 24/387 |
| 2004/0237605 | A1 * | 12/2004 | Lin | A44B 19/301 70/68 |
| 2006/0006035 | A1 | 1/2006 | Liang | |
| 2011/0186397 | A1 * | 8/2011 | Sheikh | A45C 13/00 190/120 |
| 2014/0069757 | A1 * | 3/2014 | Schlipper | A44B 19/301 24/386 |
| 2015/0374075 | A1 * | 12/2015 | Smith | A44B 19/30 24/418 |
| 2017/0020239 | A1 | 1/2017 | Cowdery et al. | |
| 2018/0332940 | A1 * | 11/2018 | Ponti | A45C 5/03 |

* cited by examiner

SECURE SLIDER FOR A ZIP FASTENER

RELATED APPLICATION

This application is a National Phase of PCT/EP2017/068816 filed on Jul. 25, 2017, the entirety of which is incorporated by reference.

BACKGROUND

Field of the Invention

The invention relates to a secure slider for a zip fastener. The invention is more specifically, but not exclusively, intended for the field of luggage and of bags or suitcases comprising a locking device for an opening comprising a zip fastener. Said locking is carried out by inserting a lock into the slider or the pull tab for maneuvering said zip fastener, whether said fastener comprises a single or a double slider.

DESCRIPTION OF THE RELATED ART

A zip fastener, also called Eclair® fastener, zipper fastener or even zip, allows two textile edges to be assembled and disassembled, on which edges a series of teeth is installed, by sewing, bonding or crimping, which teeth are able to hook together upon the passage of a slider bringing together or separating said teeth according to the direction of travel thereof along said edges. The slider comprises a hasp, onto which a pull tab is threaded that allows said slider to be easily maneuvered in the two directions, namely the opening and closing directions.

This fastening system, which is used on a piece of luggage, has numerous practical advantages, but also forms a point of weakness with regard to a malicious attempt to open said piece of luggage. The locking devices for a zip fastener that are known from the prior art involve introducing a lock into an eyelet that is specifically arranged on the hasp of the slider, or into an eyelet arranged at one end of the pull tab. Said lock secures the eyelet either with a fixed anchor point or with the eyelet of the hasp or of the pull tab of another slider acting on the same edges but in the opposite opening and closing direction. In order to open a zip fastener that is thus locked, a first method involves introducing a pointed object between the hooked edges. The double zip fastener device disclosed in document EP 2421403 allows the fastener to be secured with regard to this type of intrusion. However, the locking systems of the prior art remain vulnerable with regard to malicious acts acting directly on the slider.

By way of an example, the hasp of the slider, whether said slider is formed by a plastic or metal material, is generally open at one of the ends thereof to allow the pull tab to thread onto said hasp. Thus, the hasp is fixed to the slider by a cross-section, generally that which comprises the eyelet for locking, whereas the other cross-section comes into the vicinity of the outer table of the slider, without being connected thereto, so as to allow the pull tab to be inserted. At the same time, the pull tab is thin enough to be able to be inserted onto the hasp through the slot that is left between said hasp and the outer table of the slider. When the slider is metal, the slot is optionally closed by pinching the hasp following the installation of the pull tab. Consequently, the cross-section of the hasp must be limited to allow this deformation of said hasp. Moreover, even though in these conditions the slot is no longer visible, there is no connection between one of the ends of the hasp and the outer table of the slider. Whether the eyelet of the hasp or the eyelet of the pull tab, or both, are locked, a tool, such as a cutting blade or the end of a screwdriver, simply needs to be introduced into the hasp of the slider, and a levering force needs to be exerted by coming into abutment on the outer table of the slider, in order to separate said hasp from the slider. This maneuver allows either the pull tab to be removed from the hasp and thus allows the slider to be freely maneuvered without the pull tab if it was locked, or even allows, by continuing to apply the pressure, said hasp to be broken, thus releasing the slider.

Document FR 2145453 discloses a molding method using a movable mold allowing the slider and the pull tab to be molded in the same operation. According to this embodiment, the slider that is obtained is not a hasp slider but it is a lug slider, which only allows locking to be implemented by the pull tab, with the connection of the pull tab to the slider being particularly vulnerable.

Document U.S. Pat. No. 2,736,062 and document EP 0604695 disclose molding methods allowing simultaneous production of a hasp slider and of a pull tab. These assemblies allow the problem of the fragility of the hasp to be overcome, yet the pull tabs remain vulnerable. Indeed, due to its shape, the pull tab is sensitive to the torsion stresses that shear the branches of the eyelet for connecting the pull tab to the hasp or of its locking eyelet. Such a torsion stress is produced by introducing a blade between the two pull tabs when they are locked together, or by exerting a levering force with a blade so as to exert a bending stress in the direction of the highest inertia when the pull tab is locked to a fixed anchor point, the buckling effect produces the torsion stress and leads to the same result.

OBJECTS AND SUMMARY

The aim of the invention is to overcome the disadvantages of the prior art and to this end it relates to a slider for a zip fastener comprising a slider comprising a hasp and a pull tab, the assembly being molded as a single piece, so that the hasp is integrally formed with the table of the slider at the two longitudinal ends thereof for connecting with said table, the pull tab comprising an eyelet for connecting to the hasp of the slider, wherein:

a. the pull tab comprises a locking eyelet, the opening plane of which is parallel to the opening plane of the connection eyelet;

b. the pull tab comprises a connection portion, called pull tab body, between the two eyelets, the width of the cross-section of the pull tab body in a direction perpendicular to the opening planes of the eyelets is greater than or equal to the height of the cross-section in the plane parallel to the opening planes of said eyelets.

Thus, with the hasp of the slider being reinforced by being molded as a single piece, the connection cross-section between the two eyelets of the hasp makes it much less vulnerable to torsion stresses. Thus, the zip fastener implementing the slider that is the subject matter of the present invention exhibits greater security against attempted break-ins.

The invention is advantageously implemented according to the embodiments and the variants that are described hereafter, which are to be considered individually or according to any technically effective combination.

Advantageously, the locking eyelet is radially offset relative to the eyelet for connecting the pull tab to the hasp of the slider. Thus, the radial offset of the locking eyelet of the pull tab facilitates the maneuvering of said pull tab and, in the case of a fixed anchor point, allows the locking plane of the table of the slider to be brought nearer. Thus, the combination of the cross-section of the body of the pull tab of the slider that is the subject matter of the invention with the radial offset of the locking eyelet further reduces the vulnerability of the fastener.

Advantageously, the hasp comprises a locking eyelet. Thus, locking the slider by means of the hasp enables security to be enhanced.

Advantageously, according to this latter embodiment, the height of the open cross-section of the eyelet for connecting the pull tab to the hasp is greater than half the length of the hasp comprising its locking eyelet. Thus, the pull tab can be maneuvered above the hasp over 180° both in the longitudinal direction, by passing above the locking eyelet of the hasp, and in the radial direction. Thus, handling the zip fastener is facilitated and is more comfortable.

The invention also relates to a piece of luggage comprising a closable entry to a compartment, the fastener of which comprises a zip fastener and wherein said zip fastener comprises two sliders according to the invention, acting in the reverse opening-closing direction on said fastener. Thus, such a piece of luggage provides a possibility of locking the two sliders together.

Advantageously, the fastener for the entry to the compartment of the piece of luggage that is the subject matter of the invention comprises two superposed zippers, one inside the compartment and the other outside said compartment, each slider comprising two rails, each acting on one of said zippers. Thus, in addition to the anti-intrusion security provided by the slider, the security of this piece of luggage is also enhanced with regard to intrusion attempts made on the zipper of the zip fastener.

Advantageously, the relative height of the open surface of the eyelets for connecting the pull tabs to the hasp of the sliders relative to said hasps is able to allow the passage of the rigid shackle of a TSA type padlock. This embodiment allows both the hasp and the pull tabs to be locked by said padlock, in addition to possible separate locking to a fixed anchor point.

Advantageously, the piece of luggage that is the subject matter of the invention comprises an integrated TSA lock, on a wall of said piece of luggage, that is able to lock the locking ends of the pull tabs of the sliders. This embodiment allows the two pull tabs of the piece of luggage to be anchored in a fixed anchor point, the radial offset of the locking eyelets of the pull tabs allows them to be brought nearer to the table of the slider in the locked position, making it more difficult to introduce an object acting as a lever under the pull tab bodies.

Advantageously, according to this latter embodiment, the axes of the pull tab bodies of the sliders are longitudinally offset relative to the eyelets for connecting to the hasps, when the pull tabs are in a position such that the pull tab body is radially oriented relative to the slide of the slider. This arrangement facilitates the introduction of the locking eyelets of the pull tabs into a fixed anchor point, in particular a TSA lock integrated in the piece of luggage, and also brings together the pull tab bodies that are thus locked so that it is more difficult to introduce an object to act as a lever between the pull tabs.

BRIEF DESCRIPTION OF THE DRAWINGS

The invention is described hereafter according to the preferred embodiments thereof, which are by no means limiting, and with reference to FIGS. 1 to 7, in which.

DETAILED DESCRIPTION

Figure 1:
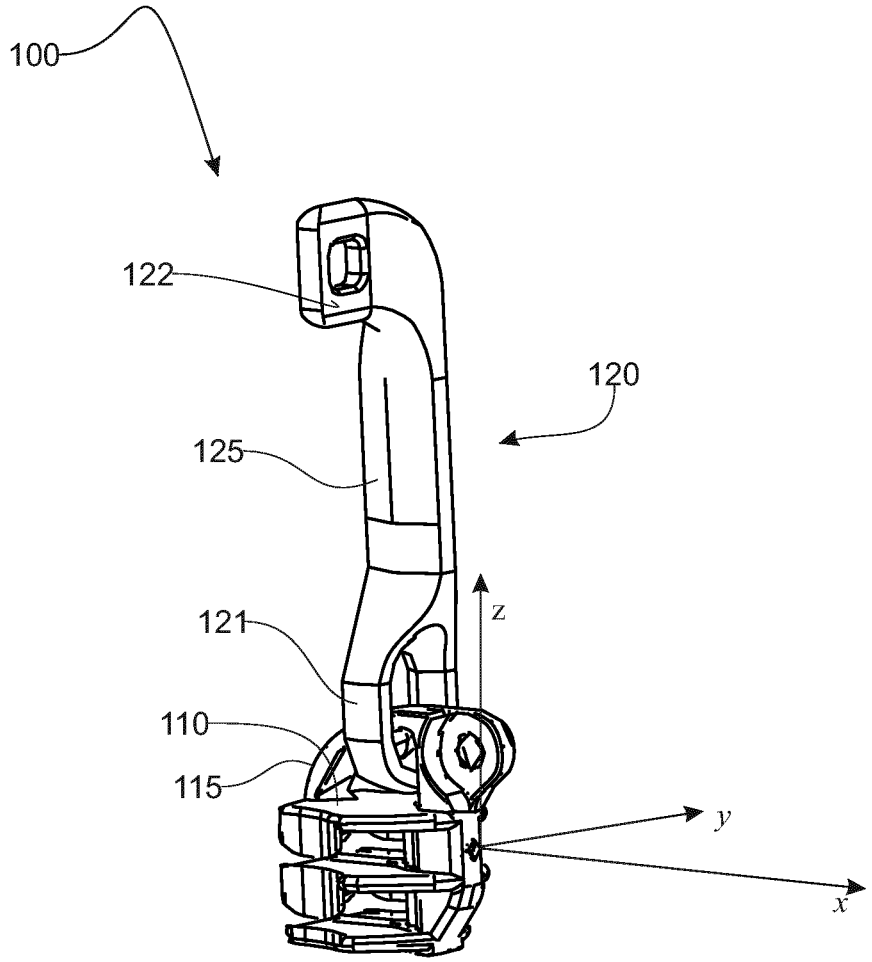
FIG. 1 shows, as a front perspective view, an embodiment of a slider that is the subject matter of the invention, the pull tab being in a vertical position.

In FIG. 1, according to one embodiment, the slider (100) that is the subject matter of the invention is adapted to close and to open two superposed zippers, as disclosed in document EP 2421403. This type of zip fastener actually provides enhanced resistance against attempts to open it by introducing a pointed object into the zippers.

Throughout the entire document the longitudinal direction, denoted x, corresponds to the direction of travel of the slider along the zippers so as to open or close them, the vertical direction, denoted z, is substantially normal to the closure plane of the zippers and to the table (110) of the slider, and the radial direction, denoted y, is perpendicular to these directions.

The pull tab (120) is connected to the hasp (115) of the slider by means of a connection eyelet (121) produced at one of the ends of its body (125), which body (125) of the pull tab comprises, at the other end thereof, a locking eyelet. According to this embodiment, when the pull tab (120) is in a vertical position, which substantially corresponds to its configuration when moving the zip fastener, the locking eyelet (122) of said pull tab (120) is radially offset relative to the body (125) of the pull tab. According to this embodiment, the opening plane of the locking eyelet (122) of the pull tab (120) and the opening plane of the eyelet (121) for connecting to the hasp of said pull tab are parallel, and are substantially parallel to the radial plane (y, z) in this position of the pull tab (120).

Figure 2:
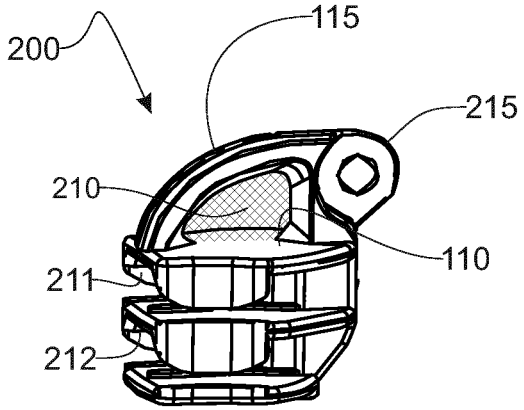
FIG. 2 shows, as a front perspective view, an embodiment of a slide of the slider that is the subject matter of the invention, shown without its pull tab.

In FIG. 2, the hasp (115) of the slider that is the subject matter of the invention forms a shackle, the opening plane (210) of which is substantially normal to the plane of the table (110) of said slider. This shackle is integrally formed with the table of the slider at the two longitudinal ends thereof for connecting with said table. In order to obtain such a result, and particularly to allow the pull tab to be connected to the hasp, the slide (200) of the slider and the pull tab of said slider are molded in the same mold, as a single piece, without an intermediate demolding operation, using a movable mold. This molding technique is known in the prior art and is not explained any further. Thus, at no time during the manufacture or the use of the slide (200) can the slide be separated from the pull tab, as shown in FIG. 2 for the sake of clarity. According to the embodiments, the slide and the pull tab are produced from the same material or from materials that are different but that allow molding to be implemented in the same mold. Thus, the slide (200) and the pull tab are both produced from a plastic material, which may or may not be reinforced, optionally from two different plastic materials, the molding temperatures of which are compatible, or are both produced from a metal alloy or from two different metal alloys, the molding conditions of which are compatible. By way of a non-limiting example, the slide (200) is made up of a material that helps the zippers to slide in the opening and closing rails (211, 212), and the pull tab is made up of a material having improved breakage resistance. According to this embodiment, the hasp (115) comprises a locking eyelet (215), allowing said hasp to be connected to the hasp of another slider acting on the same zipper or to a fixed anchor point. The production of the slide, more specifically of the hasp (115) during the same molding operation as the pull tab, allows said hasp and said pull tab to be produced, more specifically the eyelet for connecting the pull tab to the hasp, with cross-sections not restricted by the need to be able to thread the connection eyelet of the pull tab onto the hasp. Thus, both the connection eyelet of the pull tab and the hasp of the slider are produced with cross-sections that are higher, and therefore more resistant, than in the embodiments of the prior art.

Figure 3:
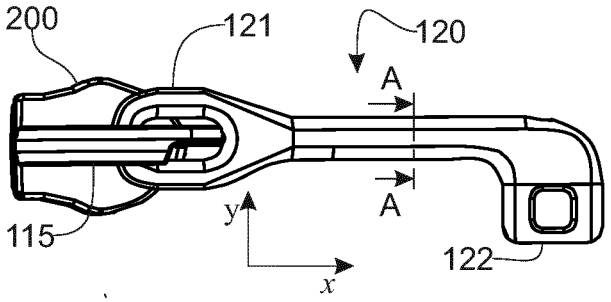
FIG. 3 shows, as a top view, an example of a position of the pull tab relative to the slide of the slider that is the subject matter of the invention.

In FIG. 3, according to an advantageous embodiment, the opening of the connection eyelet (121) of the pull tab (120) is sufficient to allow a relative rotation of said pull tab relative to the slide of 180° about the radial axis y. In particular, the opening of the eyelet (121) for connecting to the hasp is at least equal to a half-width of said hasp, including the locking eyelet of the hasp, in the longitudinal direction x. In this position of the pull tab (120), the opening plane of the eyelet (121) for connecting to the hasp and the opening plane of the locking eyelet (122) of the pull tab are substantially parallel to the plane (x, y) of the table of the slider. The embodiment of the slider allowing the cross-section of the connection eyelet to be increased thus allows a taller and wider eyelet to be produced without compromising the mechanical resistance thereof.

Figure 4:
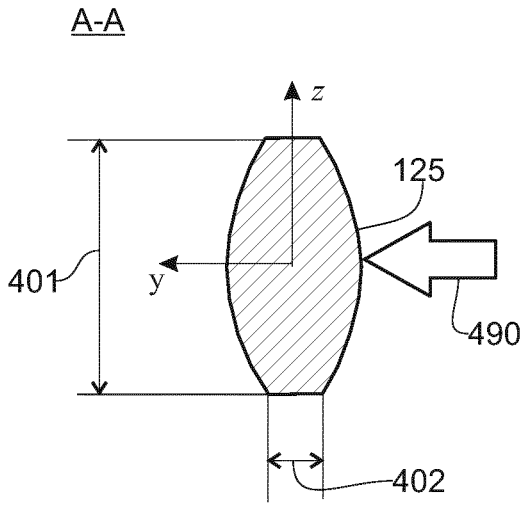
FIG. 4 is a cross-section of the body of the pull tab of a slider according to one embodiment of the invention, which cross-section is defined in FIG. 3.

In FIG. 4, along a cross-section of the body (125) of the pull tab in a plane perpendicular to the opening planes of the eyelets of the pull tab, the width (401) of the cross-section, in a direction perpendicular to the opening plane of the eyelets of the pull tab (z in the position of the pull tab as shown), is greater than the height (402) of said cross-section. This cross-section is resistant to buckling against a force (490) causing a bending torque in the plane (x, y), and is also resistant against a torsion torque about the axis x, with reference to this position of the pull tab.

Figure 5:
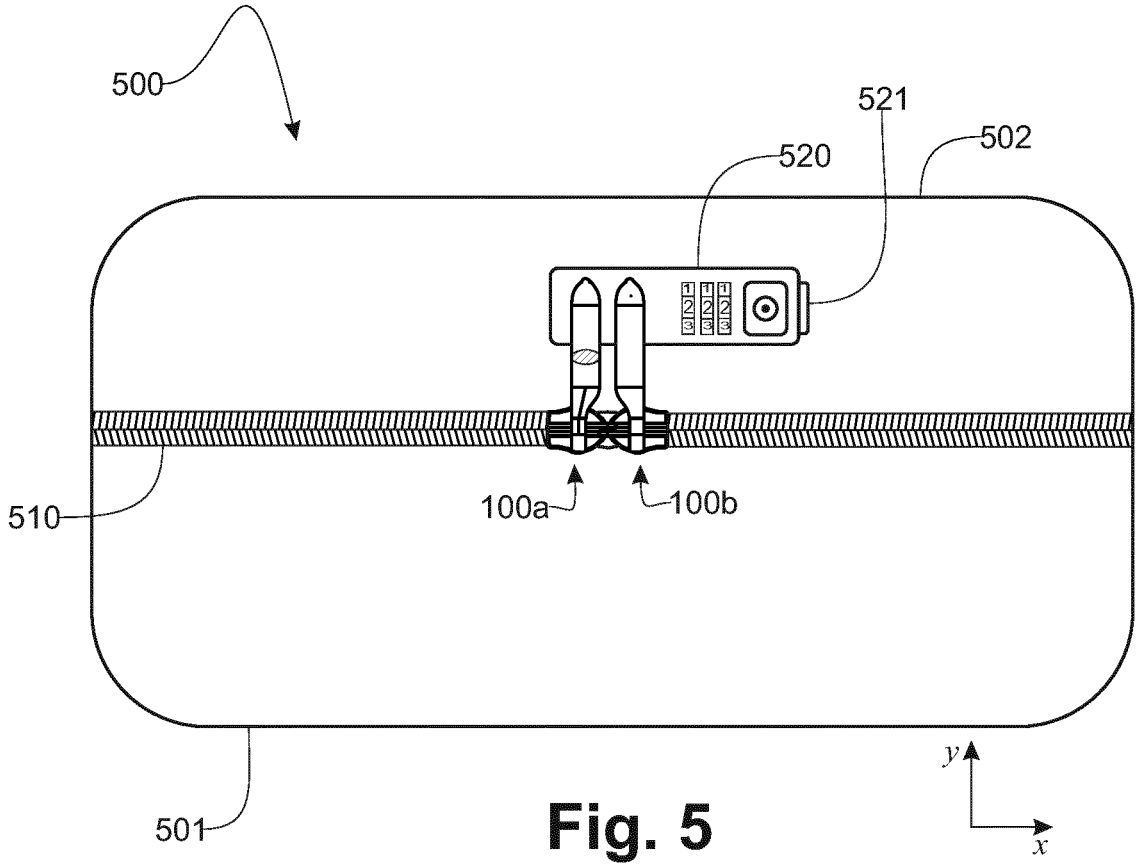
FIG. 5 schematically shows an embodiment, as a top view, of a piece of luggage according to the invention.

In FIG. 5, according to one embodiment of the piece of luggage (500) that is the subject matter of the invention, said piece of luggage comprises a shell (501) that is closed by a lid (502), with the connection between the two being made by a zip fastener (510). Advantageously, said zip fastener comprises two superposed zippers. Two sliders (100*a*, 100*b*) that are the subject matter of the invention act in the opposite direction on the zipper, or on the superposed zippers, of the zip fastener (510) of the piece of luggage (500) that is the subject matter of the invention. By way of an example, moving one (100*a*) of said sliders in the positive x direction causes the two edges of the zipper to come together and the zip fastener to close, whereas moving the other slider (100*b*) in the positive x direction causes the zip fastener to open by separating the two edges of the zipper. Said piece of luggage (500) comprises a locking anchor point (520), in the form of an integrated TSA lock that is fastened to one of the walls of the piece of luggage. Thus, in order to lock the zip fastener (510), the locking eyelets of the pull tabs of the sliders (100*a*, 100*b*) acting on said fastener (510) are inserted into housings of the anchor point (520) that are provided to this end. Locking is obtained by introducing a locking rod into the bore of said eyelets, for which rod the translation movement is controlled by a button (521) placed on the side of the anchor point (520). The radial offset of the locking eyelets of the pull tabs, as well as the shape of the cross-section of said pull tabs, limits the projecting thickness, relative to the wall of the piece of luggage, of the sliders (100*a*, 100*b*) in this locked position, so that the risks of said sliders catching with other objects, particularly when handling pieces of luggage during transshipment operations, are reduced.

Figure 6:
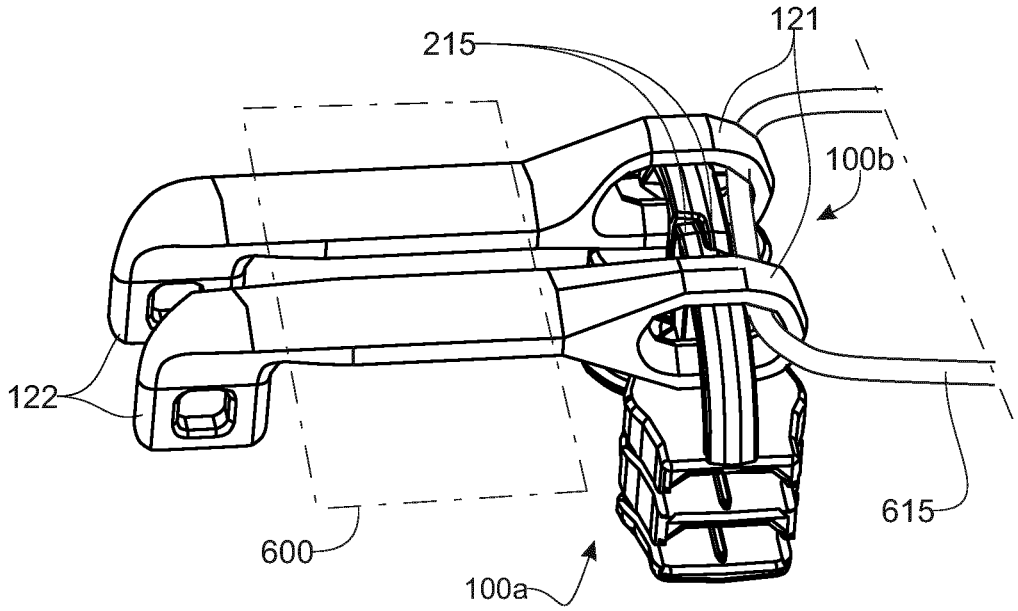
FIG. 6 shows, as a perspective view, the set of sliders of the piece of luggage of FIG. 5 in a locked position.

In FIG. 6, in the locked position of FIG. 5, the locking eyelets (122) of the pull tabs are fastened to the wall of the piece of luggage that is the subject matter of the invention using the integrated TSA lock. Due to the radial offset of said eyelets (122), the pull tab bodies are very close to the outer surface (600) of the piece of luggage and of the fixed anchor point. This proximity of the surface, combined with the round shape of the cross-section of the pull tab bodies, makes it difficult to insert an object under the pull tab body, as is the application, by means of this object, of a torsion torque along the axis of the pull tabs. The locking security is further improved by introducing a padlock into the eyelets (215) for locking the hasps of the sliders, or even by introducing the shackle (615) of a TSA type padlock into the connection eyelets (121) of the pull tabs. The diameter of the shackle of a TSA padlock is currently between 2 mm and 3 mm.

Figure 7:
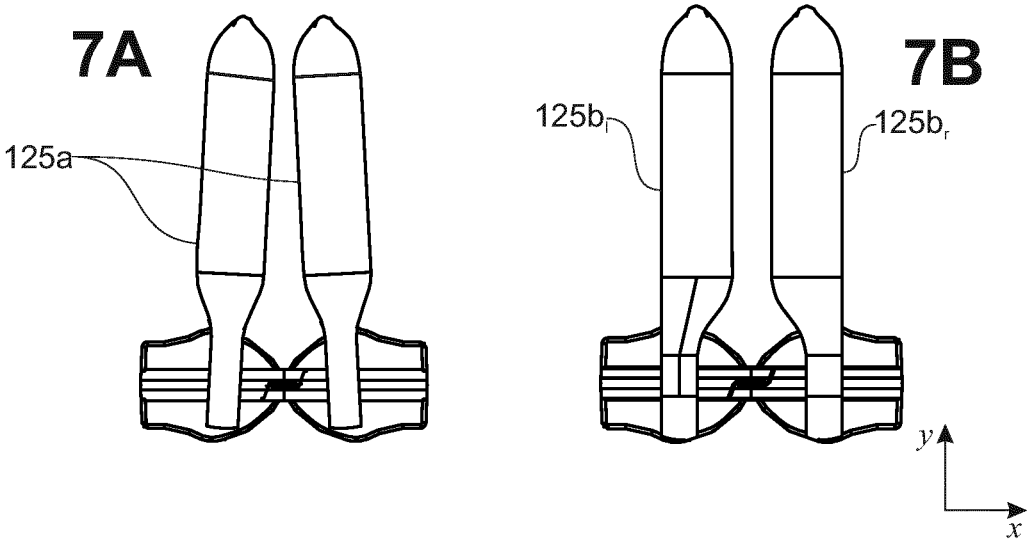
FIG. 7 shows a top view of two embodiments of the pull tabs of the sliders, intended for the piece of luggage that is the subject matter of the invention, in FIG. 7A with identical pull tabs for the two sliders and in FIG. 7B with pull tabs having a body that is longitudinally offset relative to the eyelet for connecting to the hasp.

In FIG. 7A, according to a first embodiment, the pull tabs are identical on the two sliders of the piece of luggage that is the subject matter of the invention, and the body (125*a*) of each pull tab is longitudinally centered on the eyelet for connecting to the hasp of said pull tab.

In FIG. 7B, according to another embodiment, the pull tabs of the two sliders are different. Thus, the body (125$b_1$, 125$b_r$) of each pull tab is, in this locked position, longitudinally offset from the connection eyelet towards the other slider. This configuration facilitates the introduction of the locking eyelets of the pull tabs into the housings of the fixed anchor point and also reduces the longitudinal space between the pull tab bodies in the locked position, which makes it more difficult to insert an object between said pull tabs. In this locked position, the pull tabs are substantially parallel, which, combined with the reduced projection of the pull tabs relative to the wall of the piece of luggage, improves the visual appearance of the device.

The above description and the embodiments show that the invention achieves the stated aim. Molding the pull tab and the slide of the slider as a single piece allows the hasp to be fully connected to the slider and allows the pull tab to be produced with a wide opening connection eyelet. The cross-sections of the pull tabs and of the hasp are no longer restricted by the need to thread the pull tab onto the hasp, which allows the resistance to be increased, but also allows a pull tab body to be produced that is thicker rather than wider, unlike the embodiments of the prior art, thus enhancing the resistance of the pull tab to torsion and to buckling. The various geometrical features of the slider and its embodiment combine to produce a zip fastener that is particularly resistant to malicious intrusion attempts, but is also easier to handle, is more aesthetic and is more secure than the embodiments of the prior art.

The invention claimed is:

1. A slider for a zip fastener comprising:

a slide having a hasp; and a pull tab, wherein said slide and hasp, and said pull tab together form an assembly that is molded as a single piece, where the hasp is integrally formed with a table of the slide at two longitudinal ends thereof, for connecting with said table, the pull tab comprising a connection eyelet connected to the hasp of the slide, and wherein:

a. the pull tab further comprises a locking eyelet with an opening plane that is parallel to an opening plane of the connection eyelet;

b. the pull tab has a pull tab body, between the connection eyelet and the locking eyelet, a width of a cross-section of the pull tab body in a direction perpendicular to the opening planes of the eyelets is greater than or equal to a height of a cross-section in the plane parallel to the opening planes of said connection eyelet and the locking eyelet, wherein the hasp further comprises a hasp locking eyelet, and wherein a height of an open cross-section of the connection eyelet for connecting the pull tab to the hasp is greater than half a length of the hasp, including its hasp locking eyelet.

2. The slider as claimed in claim 1, wherein the locking eyelet of the pull tab is radially offset relative to the eyelet for connecting the pull tab to the hasp of the slide.

3. A piece of luggage comprising a closable entry to a compartment, a fastener of which comprises a zip fastener, wherein said zip fastener two sliders as claimed in claim 1, acting in the reverse opening-closing direction on said zip fastener.

4. The piece of luggage as claimed in claim 3, for which the fastener of the entry to the compartment comprises two superposed zippers, one inside the compartment and the other outside said compartment, and wherein each slider comprises two rails each acting on one of the two zippers.

5. The piece of luggage as claimed in claim 3, wherein the relative height of the open surface of the connection eyelets for connecting the pull tabs to the hasps of the sliders, relative to said hasps, is able to allow the passage of a rigid shackle of a Transportation Security Administration (TSA) complaint padlock.

6. The piece of luggage as claimed in claim 3, comprising two sliders, wherein the locking eyelet of the pull tab is radially offset relative to the eyelet for connecting the pull tab to the hasp of the slide, and having comprising a Transportation Security Administration (TSA) compliant lock, integrated with said two sliders, said lock forming a fixed anchor point, on a wall of said piece of luggage, that is able to lock the locking eyelets of the pull tabs of the sliders.

7. The piece of luggage as claimed in claim 6, wherein the bodies of the pull tabs of the sliders are longitudinally offset relative to the eyelets when the pull tabs are in a position such that the pull tab body is radially oriented relative to the slide of the slider.

* * * * *